US006405385B1

(12) United States Patent
Smith

(10) Patent No.: US 6,405,385 B1
(45) Date of Patent: Jun. 18, 2002

(54) PLUNGER DEVICE

(76) Inventor: Willie Smith, 5029 Old Rural Hall Rd., Winston Salem, NC (US) 27105

( * ) Notice: Subject to any disclaimer, the term of this patent is extended or adjusted under 35 U.S.C. 154(b) by 0 days.

(21) Appl. No.: 09/844,336

(22) Filed: Apr. 27, 2001

(51) Int. Cl.[7] ..... E03C 1/308
(52) U.S. Cl. ..... 4/255.01; 4/255.04
(58) Field of Search ..... 4/255.01, 255.04, 4/255.05, 255.08, 255.11, 255.12

(56) References Cited

U.S. PATENT DOCUMENTS

| | | | | | |
|---|---|---|---|---|---|
| 937,458 | A | * | 10/1909 | Mulherin | 4/255.04 |
| 950,549 | A | | 3/1910 | Kurrus | |
| 1,575,102 | A | * | 3/1926 | Fiset | 4/255.01 |
| 2,626,405 | A | * | 1/1953 | Keith | 4/255.04 |
| 2,844,826 | A | * | 7/1958 | Cheiten | 4/255.11 |
| 3,994,032 | A | | 11/1976 | Spickofsky | |
| 4,847,923 | A | | 7/1989 | Huang | |
| 5,239,708 | A | | 8/1993 | Irwin | |
| D404,178 | S | | 1/1999 | Wetzler | |
| 5,927,957 | A | | 7/1999 | Kennedy et al. | |
| 6,067,668 | A | * | 5/2000 | Rudd | 4/255.11 |

FOREIGN PATENT DOCUMENTS

| | | | | |
|---|---|---|---|---|
| CH | 201894 A | * | 3/1939 | 4/255.04 |
| DE | 3838978 A | * | 5/1990 | 4/255.04 |
| GB | 21239 A | * | 12/1890 | 4/255.01 |

* cited by examiner

*Primary Examiner*—Charles R. Eloshway

(57) ABSTRACT

A plunger device for unclogging a toilet drain includes a housing which is elongated and has a open first end and an open second end. A peripheral wall extends between the first and second ends. The first and second ends are generally circular. The first end has a smaller diameter than a diameter of the second end. The diameter of the second end is larger than a toilet drain. A may be used for forcing air into the housing and is removably in communication with the first end of the housing. The second end of the housing is positioned over the toilet drain such that air is moved from the pump and into the housing causing water in the toilet to be forced into the drain and unclogging the drain.

2 Claims, 2 Drawing Sheets

PLUNGER DEVICE

BACKGROUND OF THE INVENTION

1. Field of the Invention

The present invention relates to plunger devices and more particularly pertains to a new plunger device for unclogging a toilet drain.

2. Description of the Prior Art

The use of plunger devices is known in the prior art. More specifically, plunger devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,847,923; U.S. Pat. No. 5,927,957; U.S. Pat. No. 950,549; U.S. Pat. No. 3,994,032; U.S. Pat. No. 5,239,708; and U.S. Des. Pat. No. 404,178.

While these devices fulfill their respective, particular objectives and requirements, the aforementioned patents do not disclose a new plunger device. The inventive device includes a housing which is elongated and has a open first end and an open second end. A peripheral wall extends between the first and second ends. The first and second ends are generally circular. The first end has a smaller diameter than a diameter of the second end. The diameter of the second end is larger than a toilet drain. A pumping means forces air into the housing. The pumping means is removably in communication with the first end of the housing. The second end of the housing is positioned over the toilet drain such that air is moved from the bladder and into the housing causing water in the toilet to be forced into the drain and unclogging the drain.

In these respects, the plunger device according to the present invention substantially departs from the conventional concepts and designs of the prior art, and in so doing provides an apparatus primarily developed for the purpose of unclogging a toilet drain.

SUMMARY OF THE INVENTION

In view of the foregoing disadvantages inherent in the known types of plunger devices now present in the prior art, the present invention provides a new plunger device construction wherein the same can be utilized for unclogging a toilet drain.

The general purpose of the present invention, which will be described subsequently in greater detail, is to provide a new plunger device apparatus and method which has many of the advantages of the plunger devices mentioned heretofore and many novel features that result in a new plunger device which is not anticipated, rendered obvious, suggested, or even implied by any of the prior art plunger devices, either alone or in any combination thereof.

To attain this, the present invention generally comprises a housing which is elongated and has a open first end and an open second end. A peripheral wall extends between the first and second ends. The first and second ends are generally circular. The first end has a smaller diameter than a diameter of the second end. The diameter of the second end is larger than a toilet drain. A pumping means forces air into the housing. The pumping means is removably in communication with the first end of the housing. The second end of the housing is positioned over the toilet drain such that air is moved from the bladder and into the housing causing water in the toilet to be forced into the drain and unclogging the drain.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new plunger device apparatus and method which has many of the advantages of the plunger devices mentioned heretofore and many novel features that result in a new plunger device which is not anticipated, rendered obvious, suggested, or even implied by any of the prior art plunger devices, either alone or in any combination thereof.

It is another object of the present invention to provide a new plunger device which may be easily and efficiently manufactured and marketed.

It is a further object of the present invention to provide a new plunger device which is of a durable and reliable construction.

An even further object of the present invention is to provide a new plunger device which is susceptible of a low cost of manufacture with regard to both materials and labor, and which accordingly is then susceptible of low prices of sale to the consuming public, thereby making such plunger device economically available to the buying public.

Still yet another object of the present invention is to provide a new plunger device which provides in the apparatuses and methods of the prior art some of the advantages thereof, while simultaneously overcoming some of the disadvantages normally associated therewith.

Still another object of the present invention is to provide a new plunger device for unclogging a toilet drain.

Yet another object of the present invention is to provide a new plunger device which includes a housing which is elongated and has a open first end and an open second end. A peripheral wall extends between the first and second ends.

The first and second ends are generally circular. The first end has a smaller diameter than a diameter of the second end. The diameter of the second end is larger than a toilet drain. A pumping means forces air into the housing. The pumping means is removably in communication with the first end of the housing. The second end of the housing is positioned over the toilet drain such that air is moved from the bladder and into the housing causing water in the toilet to be forced into the drain and unclogging the drain.

Still yet another object of the present invention is to provide a new plunger device that has a pumping means which may be stepped on for applying a large amount of pressure into the toilet drain.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
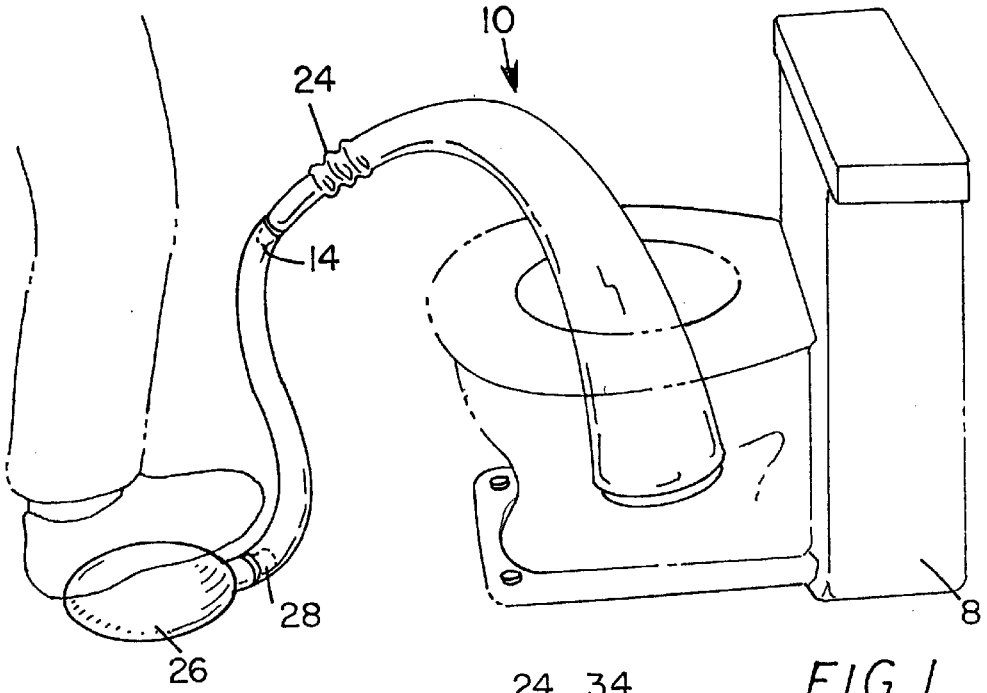
FIG. 1 is a schematic side view of a new plunger device according to the present invention.
Figure 2:
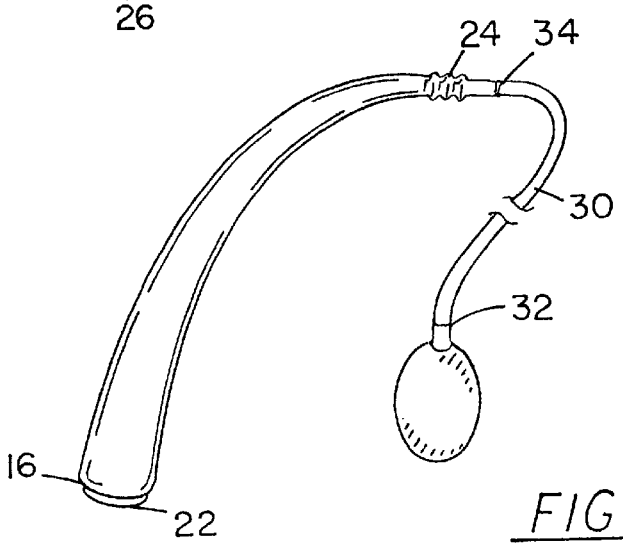
FIG. 2 is a schematic side view of the present invention.
Figure 3:
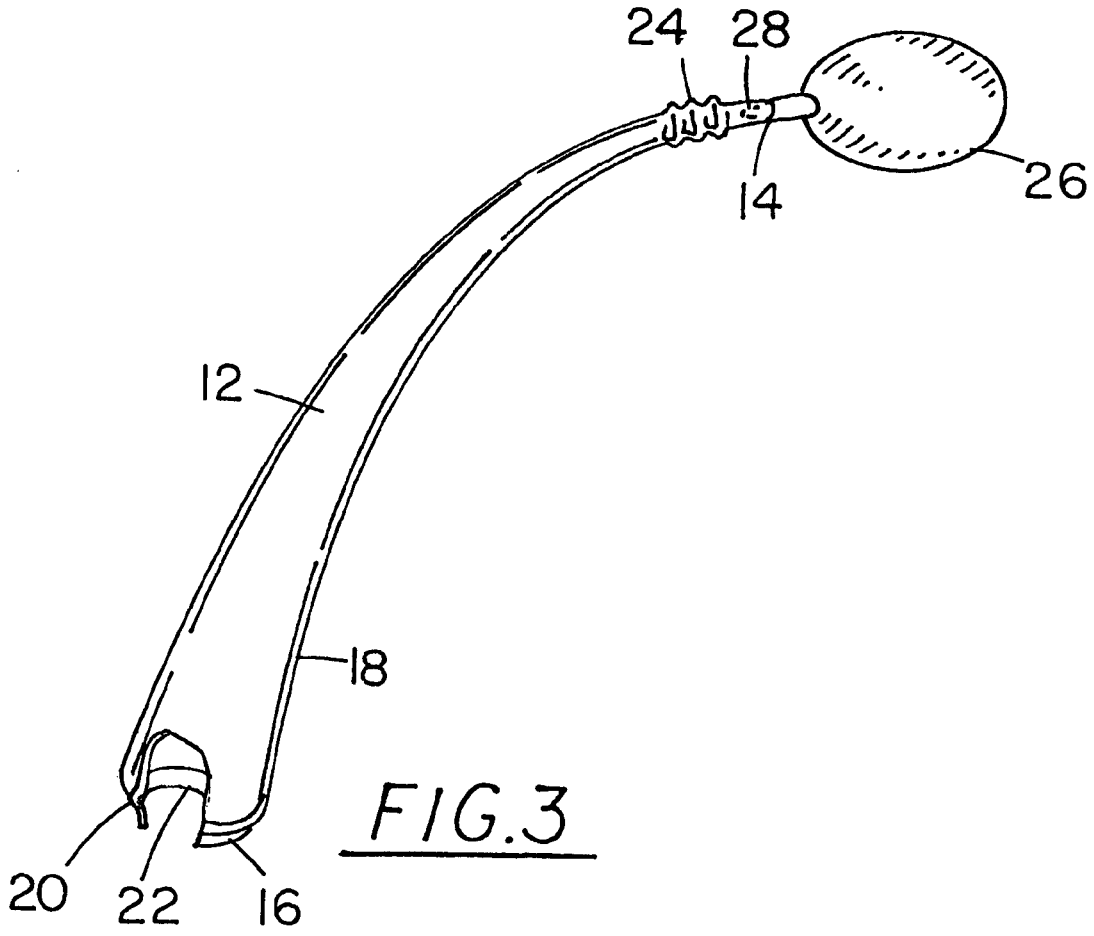
FIG. 3 is a schematic side view of the present invention.

With reference now to the drawings, and in particular to FIGS. 1 through 3 thereof, a new plunger device embodying the principles and concepts of the present invention and generally designated by the reference numeral 10 will be described.

As best illustrated in FIGS. 1 through 3, the plunger device generally comprises a housing 12 which is elongated and has a open first end 14 and an open second end 16. A peripheral wall 18 extends between the first 14 and second 16 ends. The first 14 and second 16 ends are generally circular. The first end 14 has a smaller diameter than a diameter of the second end 16. The diameter of the second end 16 is larger than the toilet drain. An annular flange 20 is integrally coupled to the second end 16 and extends inward. A neck 22 is integrally coupled to the flange 20 and extends away from the housing 12. An upper portion 24 of the peripheral wall positioned generally adjacent to the first end 14 is corrugated. The housing 12 comprises resiliently elastic material.

A pumping means 26 forces air into the housing 12. The pumping means 26 comprises a bladder having an outlet port 28 fluidly coupled thereto. The outlet port 28 is removably positionable in the first end 14 of the housing 12 such that the pumping means 26 is in communication with the housing 12. The bladder comprises a resiliently flexible material.

A tube 30 has a first end 32 and a second end 34. The outlet port 28 of the pumping means 26 is removably positionable in the first end 32 of the tube 30 and the first end 14 of the housing 12 is removably positionable in the second end 34 of the tube 30 such that the pumping means 26 is in communication with the housing 12.

In use, the second end 16 of the housing 12 is positioned over the toilet drain such that air is moved from the bladder and into the housing 12 such that water in the toilet 8 is forced into the drain. The tube 30 may be used for positioning the pumping means on the floor so that person may step on the pumping means. The corrugated upper portion 24 of the housing allows for easier bending of the housing 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of plunging a toilet comprising the steps of:

providing an elongated housing having an interior and an open first end and an open second end with a peripheral wall extending between said first and second ends, and a pump being in fluid communication with said first end of said housing for forcing air into and through said housing, said pump including a resiliently flexible bladder with an interior that is at least partially collapsible by applying pressure to an outer surface of the pump;

positioning said second end of said housing over the toilet drain and against a perimeter of the toilet drain such that the interiors of said housing and said bladder are in fluid communication with the toilet drain; and placing said pump on a ground surface; and pressing against the outer surface of said bladder with a body part of a user toward the ground surface such that said bladder is at least partially collapsed between the body part and the ground surface to force air from inside the interior of said bladder through the interior of said housing and into the toilet drain.

2. The method of plunging a toilet as in claim 1, wherein said step of pressing against the outer surface of said pump includes stepping on the pump with a foot of the user.

* * * * *